US005919080A

United States Patent [19]

Savoie et al.

[11] Patent Number: 5,919,080

[45] Date of Patent: Jul. 6, 1999

[54] OPHTHALMIC LENS BLOCKER

[75] Inventors: Marc Y. Savoie; Gary V. Underhill, both of Moncton, Canada

[73] Assignee: Micro Optics Design Corporation, Irvine, Calif.

[21] Appl. No.: 08/944,534

[22] Filed: Oct. 7, 1997

[30] Foreign Application Priority Data

May 30, 1997 [CA] Canada ..... 2206539

[51] Int. Cl.[6] ..... B24B 49/00

[52] U.S. Cl. ..... 451/5; 451/8; 451/460; 451/390; 451/384

[58] Field of Search ..... 451/460, 390, 451/384, 6, 5, 8, 42

[56] References Cited

U.S. PATENT DOCUMENTS

| | | | |
|---|---|---|---|
| 3,663,983 | 5/1972 | Bole | 51/277 |
| 3,804,153 | 4/1974 | Tagnon . | |
| 4,288,946 | 9/1981 | Bicskei . | |
| 4,319,846 | 3/1982 | Henry et al. . | |
| 4,330,203 | 5/1982 | Oppenheim et al. | 356/127 |
| 4,677,729 | 7/1987 | Morland et al. | 29/426.5 |
| 4,737,918 | 4/1988 | Langlois et al. | 364/474 |
| 5,080,482 | 1/1992 | Benz et al. . | |
| 5,283,980 | 2/1994 | Lohrenz et al. . | |
| 5,425,665 | 6/1995 | Kennedy | 451/5 |
| 5,498,200 | 3/1996 | Werner . | |
| 5,505,654 | 4/1996 | Wood et al. . | |
| 5,720,647 | 2/1998 | Gottschald | 451/5 |
| 5,721,644 | 2/1998 | Murray et al. | 359/819 |

*Primary Examiner*—David A. Scherbel
*Assistant Examiner*—Dung Van Nguyen
*Attorney, Agent, or Firm*—Mario D. Theriault

[57] ABSTRACT

An ophthalmic lens blocker for blocking a lens blank onto a support block without touching the block. The lens blocker has a lens blank imaging station for displaying a target image of a prescribed lens and a planar coordinate system associated with this target image. The imaging station has a stand for supporting the lens blank for orienting the lens blank according to references in the planar coordinate system. There is also provided a probing station for measuring a position and curvature of a surface of the lens blank and a lens/block moulding station having a cavity for receiving the support block in a known position and a bonding material dispenser for bonding the lens blank to the support block. The lens blocker further has a lens blank manipulator for moving the lens blank from the imaging station to the probing station and from the probing station to the lens/block moulding station. A central processor unit is also provided for controlling the operation of the lens blocker and for registering the spacial orientation of the lens blank, the spacial position and curvature of the surface of the lens blank, and for associating these coordinates to the known position of the support block in the cavity of the lens/block moulding station. The lens blank manipulator has a vacuum pickup device for holding the lens blank and a plurality of prop stems disposed about the pickup device for stabilizing the lens blank when the lens blank is manipulated by the pickup device.

20 Claims, 10 Drawing Sheets

OPHTHALMIC LENS BLOCKER

FIELD OF THE INVENTION

The present invention relates to an apparatus for bonding an ophthalmic lens blank to a support block for supporting the lens blank during a lens generating process, with the data of the lens blank being correlated to three-dimensional references on the support block. More particularly, the present invention relates to an apparatus for registering X-Y coordinates of the geometric center of a lens blank, the position and orientation of the cylindrical axis of the lens blank, the location of a bifocal segment, the curvatures and locations of the concave and convex surfaces of the lens blank along the Z-axis, and for relating these data to the coordinates of a datum plane, a transversal axis and the chucking axis on the support block.

BACKGROUND OF THE INVENTION

A blocking of an ophthalmic lens blank is required prior to working the lens blank in a lens generating apparatus. Modern ophthalmic lens generating apparatus of particular interest herein are computer-controlled machines capable of generating a final optical surface on an ophthalmic lens in a single operation. These apparatus also include profiling machines capable of shaping the contour of the lens while the lens blank remains bonded to the original support block used during the surface generation process.

As can be appreciated, the precision of these machines depends greatly upon the accuracy with which the lens blank is affixed to the support block. As may also be appreciated, the efficiency of these machines depends greatly upon the available information about the lens blank, for programming the controller of the machine. For example, when the locations and curvatures of both surfaces of a lens blank are known precisely, it is possible for the controller of the machine to calculate the amount of material to be removed during the surface generating process, the exact coordinates for an initial cut, the total number of cuts required, the depth of cut for a finishing pass and the total duration of the surface generating process. These values may thereafter be analysed for devising an optimum cycle time for manufacturing an ophthalmic lens, and for generating lens of a highest quality.

Generally, it has been difficult with the lens blockers of the prior art, to obtain accurate information about the surfaces and thickness of a lens blank for supporting a significant optimization of the efficiency of a lens generating apparatus. In the past, emphasis has been placed on the precision in the positioning of the optical references of a lens blank relative to the support block. The physical locations and curvatures of both surfaces have been of a secondary interest.

For this reason also, and despite the use of ultra-precision computer-controlled apparatus, ophthalmic lens generated nowadays are not always errorless. Ophthalmic lens are often thicker than they could be for providing a good appearance when mounted in a thin frame for example. Another common error found in ophthalmic lenses is referred to in the industry as spherical aberrations in the lenses. This type of error is related to the inconstancy of the focal length of the incident rays of light passing through the lens at various locations across the surface of the lens and especially near the edges of the lens. Both types of errors are often related, amongst other things, to an insufficient knowledge of the exact location and curvature of at least one surface of the lens blank.

The machines of the prior art for blocking a lens have evolved from a basic manual and visual alignment of markings on the lens blank with references on the support block, to semi-automatic equipment using a pick and place manipulator and LCD generated target images for positioning the lens blank. In this respect, a representative group of lens blockers of the prior art is presented hereinbelow.

In a first example of lens blocker of the prior art, the U.S. Pat. No. 3,804,153 issued on Apr. 16, 1974 to Luc Andre Tagnon illustrates a device for positioning a mold for casting a metal block onto the surface of a lens. The mold is movable by means of a spherical swivel joint and pantograph linkage such that the reference axes of the mold are movable to coincide with the optical axes of the lens blank, and such that the mold always makes direct contact with the curved surface of the lens. The reference axes on the metal block are later used for controlling the movements of a lens trimming and bevelling machine.

A second example of lens blocking device of the prior art is described in the U.S. Pat. No. 4,288,946 issued on Sep. 15, 1981 to Bela J. Bicskei. The device comprises a tripod on which an ophthalmic lens is placed, and a projector and minor assembly for projecting a target image from under the tripod. The lens is manually positioned on the tripod with the optical markings on the lens corresponding to the target image of the projection. When the lens is properly positioned, an articulated blocking aim is used for precisely positioning and securing a support block to the lens blank.

In another example, the U.S. Pat. No. 4,319,846 issued on Mar. 16, 1982 to David W. Henry et al. describes a method and apparatus for aligning a lens blank upon a lens blocking station. A transparent indicia is movable back and forth over a lens supported on a blocking station. The indicia is firstly used to properly position the lens blank over the blocking station, with the optical axes of the lens blank being in a consistent orientation relative to the blocking station.

Another example of lens blocking devices of the prior art is described in U.S. Pat. No. 5,283,980 issued on Feb. 8, 1994 to Marold H. Lohrenz et al. With this device, a lens blank is placed over a sheet of non-slip transparent material covering a liquid crystal display connected to a computer. The LCD exhibits a target image generated by the computer. The lens is manually positioned over the sheet of non-slip material according to the markings of the target image. The computer calculates and compensates for the optical error in the refractive characteristics of the non-slip sheet and the viewing glass, and shifts the target image to account for the error. Once the lens is properly positioned, a lens support block is affixed to the lens blank using a blocking arm capable of applying a constant force to the lens independently of the height of the lens blank.

The U.S. Pat. No. 5,498,200 issued on Mar. 12, 1996 to Ralf Werner describes a device for attaching a holder to a lens blank before grinding the edge of a lens blank. The lens blank is placeable over a glass plate carrying a tripod stand. A LCD screen is used to project a scale, a template image or an eyeglass frame opening image. A prism is positioned between the lens blank and the eye of an operator of the device for superimposing the projection of the LCD screen onto the image of the lens blank. The tripod is raiseable to a predetermined height before the lens blank is adjusted on the tripod and a support block is affixed thereto.

A last example of a lens blocker of the prior art is described in U.S. Pat. No. 5,505,654 issued on Apr. 9, 1996 to Kenneth O. Wood et al. The apparatus comprises an alignment station for supporting and aligning the lens blank with a target image generated by a liquid crystal display. Both the image of the lens and the target image are projected on a viewing mirror in front of the operator of the apparatus. The apparatus also has a movable pick and place arm with a vacuum picking cup for moving the lens from the alignment station to a blocking station while maintaining the lens orientation. The blocking station includes a support for a lens block, a support for the lens blank and a system for injecting heated liquid bonding material between the lens and the block which solidifies on cooling to join the lens and block together.

As explained before, the devices and apparatus of the prior art have attached little importance to the measurement of the exact positions of both surfaces of a lens blank, and to the verification of the curvature of these surfaces. As a result, a first surface is often generated in a lens blank without knowing precisely where the second surface really is.

Furthermore, some devices and apparatus of the prior art use lens supports and vacuum picking cups made of resilient material such as rubber for example. Although the positioning of the lens is precisely effected at the imaging station, the manipulation of the lens using flexible members prior to bonding the lens can cause slight misalignment of the lens during the bonding of the lens to the support block thus causing a prism error in the lens.

SUMMARY OF THE INVENTION

In the present invention, however, there is provided an ophthalmic lens blocker having means for measuring the location and curvature of both surfaces of the lens before mounting the lens on a support block. The lens blocker of the present invention further has a lens pickup device with stabilizers for maintaining an accurate alignment of the lens blank during the manipulation and blocking of the lens blank on the support block.

In one aspect of the present invention, there is provided an ophthalmic lens blocker comprising a lens blank imaging station having means for displaying a planar coordinate system and means for supporting a lens blank for orienting the lens blank according to references in the planar coordinate system, and a lens/block moulding station having means for receiving the support block in a known position and means for bonding the lens blank to the support block. The ophthalmic lens blocker of the present invention further has a lens blank manipulator having means for moving the lens blank from the imaging station to the lens/block moulding station.

The means for moving the lens blank comprises a vacuum pickup device for holding the lens blank and a plurality of prop stems disposed about the vacuum pickup device for contacting and stabilizing the lens blank when the lens blank is held in the vacuum pickup device.

A first advantage of this aspect of the present invention is that the lens blank is held in a constant position despite possible fluctuations in the vacuum level in the vacuum pickup device, or despite the resiliency of the material with which the vacuum pickup device is made. Hence, a measured spacial position and a set spacial alignment of the lens blank are precisely associable with references on the support block.

In another aspect of the present invention, the lens blocker of the present invention comprises a probing station disposed between the imaging station and the lens/block moulding station. The probing station has means for measuring a position and curvature of a first surface of the lens blank relative the lens/block moulding station.

The first surface of the lens blank is therefore mountable over the support block at a known distance from the block and a location and curvature of this first surface of the lens blank are accurately associable with references on the support block. In this respect, the mounting of a lens blank at a distance from the support block is particularly appreciable during the shaping of the contour of the lens when the edging tool might interfere with a portion of the support block for example.

In a further aspect of the present invention the lens blank pickup device has switch means for detecting a movement of the prop stems when the lens blank manipulator is brought in contact with the lens blank. The lens blank manipulator further has a vacuum cup position sensor for detecting a position of the vacuum cup against the surface of the lens. Thus a distance travelled by the lens blank manipulator between a touching of the prop stems on the second surface of the lens blank and a touching of the vacuum cup on the second surface of the lens blank are integrable by the central processor unit controlling the operation of the lens blocker for calculating a curvature of the second surface of the lens blank.

The blocker of the present invention is particularly effective in mounting a lens blank on a support block with the X-Y coordinates of the geometric center of a lens blank, the position and orientation of the cylindrical axis of the lens blank, the location of a bifocal segment, the shapes and locations of the concave and convex surfaces of the lens blank along the Z-axis, are precisely associable with the coordinates of a datum plane, a transversal axis and the chucking axis on the support block. This information is thereby usable for increasing the efficiency of the lens blocker of the present invention and for verifying the curvature and position of the lens blank in an effort to manufacture errorfree ophthalmic lenses.

BRIEF DESCRIPTION OF THE DRAWINGS

The preferred embodiment of the present invention will be further understood from the following description, with reference to the drawings in which.

DETAILED DESCRIPTION OF THE PREFERRED EMBODIMENT

Figure 1:
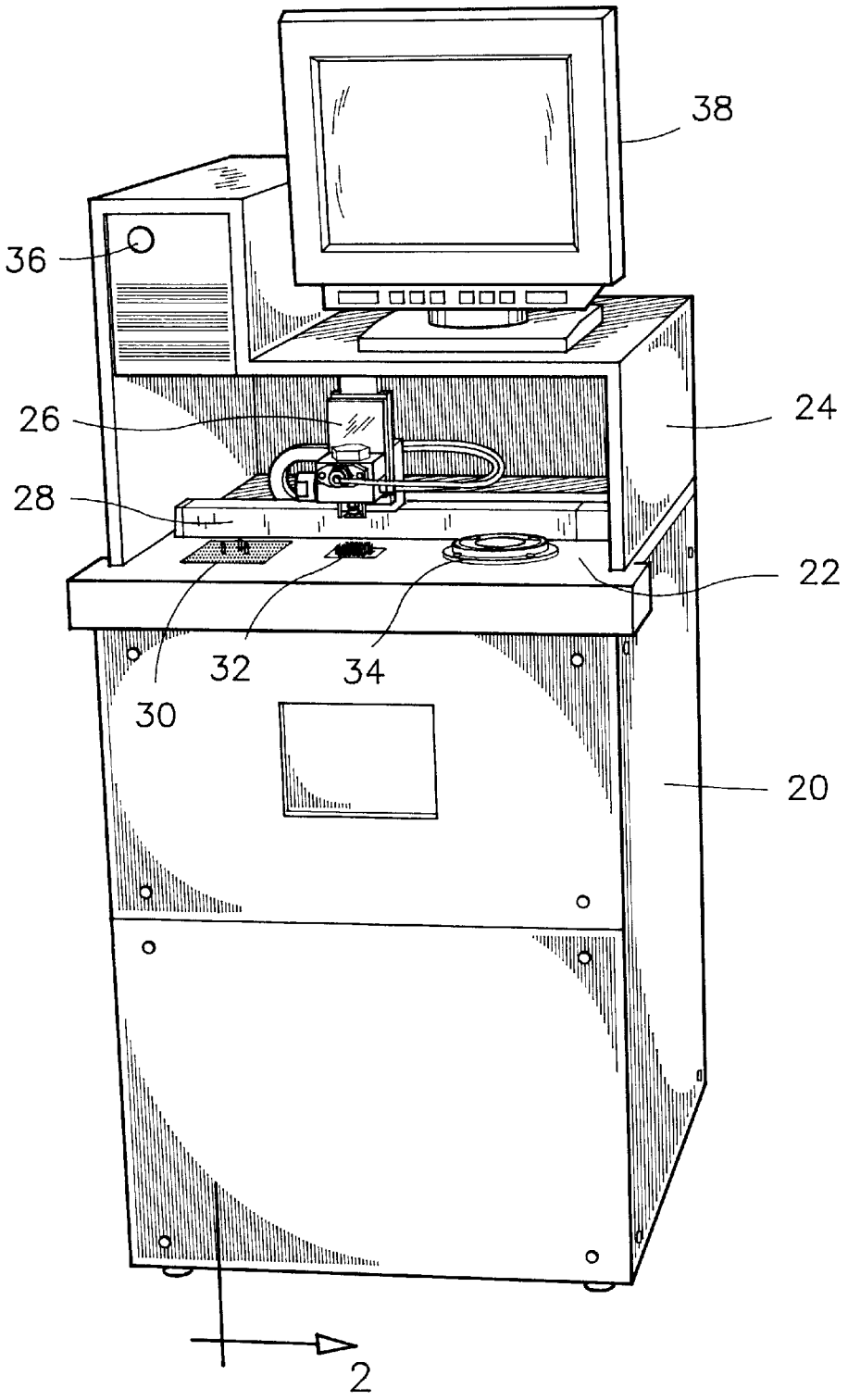
FIG. 1 is a front, top and right side perspective view of the ophthalmic lens blocker of the preferred embodiment.
Figure 2:
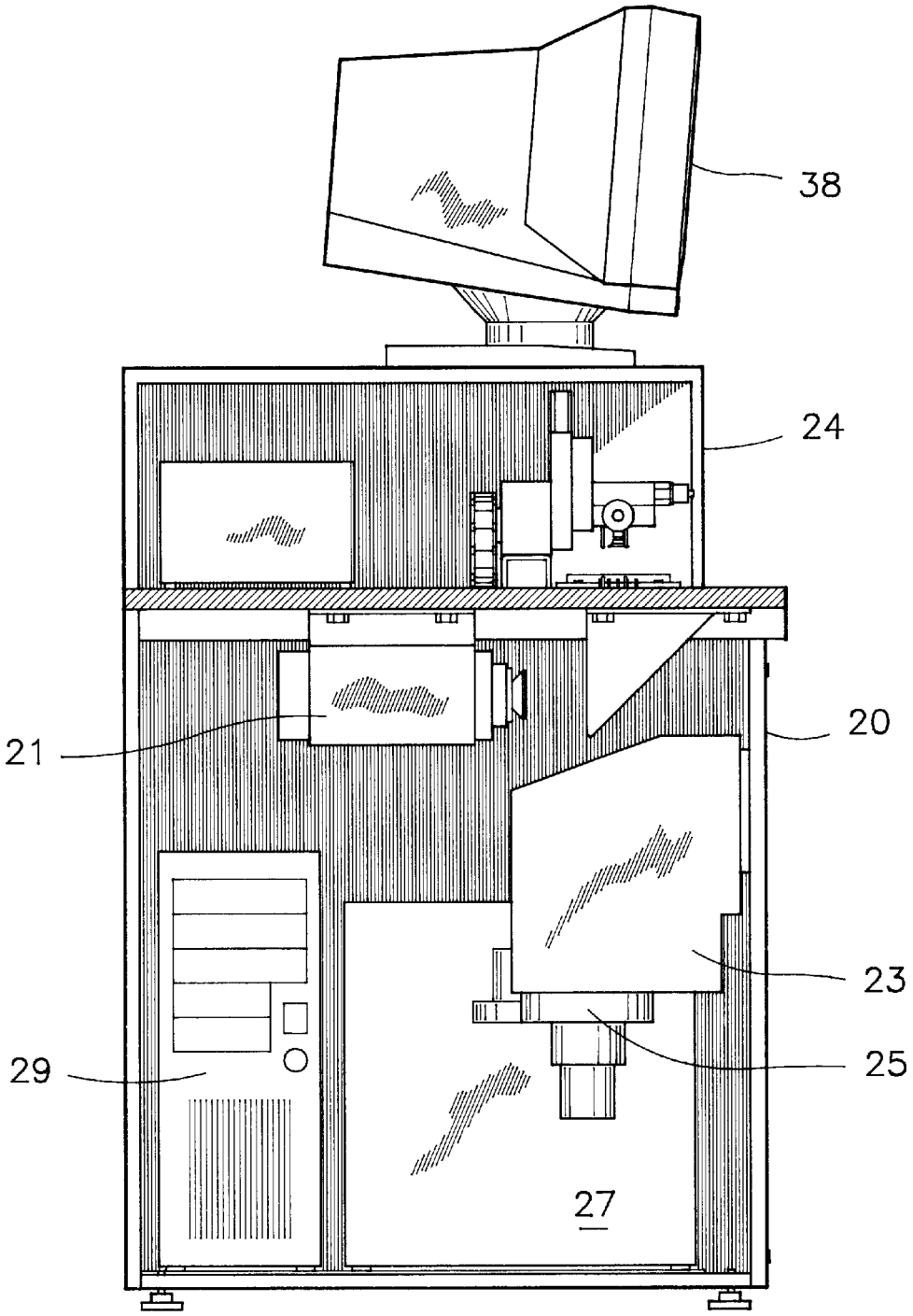
FIG. 2 is a cross-section view inside the cabinet of the ophthalmic lens blocker of the preferred embodiment taken along line 2 in FIG. 1.

The ophthalmic lens blocker of the preferred embodiment is illustrated in its entirety in FIGS. 1 and 2. The ophthalmic lens blocker comprises a cabinet 20 having a top surface 22 and a hood structure 24 partly enclosing the top surface 22. A lens blank manipulator 26 is movably mounted on a first linear actuator 28 affixed to the top surface 22. The first linear actuator 28 has a first servo motor or stepper motor/encoder unit for moving the lens blank manipulator 26 therealong and for monitoring its position at all times.

The ophthalmic lens blocker of the preferred embodiment also has, aligned along the first linear actuator 28 and incorporated in the top surface 22 of the cabinet 20, a lens imaging station 30, a lens probing station 32 and a lens/block moulding station 34.

The cabinet 20 encloses a camera 21 focused on the imaging station 30, a wax reservoir 23 and a wax heating and pumping unit 25 for pumping molten wax to the lens/block moulding station 34, a chiller 27 for cooling the lens/block moulding station and a central processing unit (CPU) 29 for controlling the operation of the lens blocker.

The hood 24 has a compartment on the left side thereof enclosing control circuitry comprising an on-off switching device 36 and a light source (not shown) for illuminating the imaging station 30. The hood 24 also has a support surface supporting a CRT screen 38. The CRT screen 38 is preferably a "touch-type" screen whereby the controlling of the operation of the lens blocker is effected by touching command buttons appearing directly on that screen 38.

Figure 3:
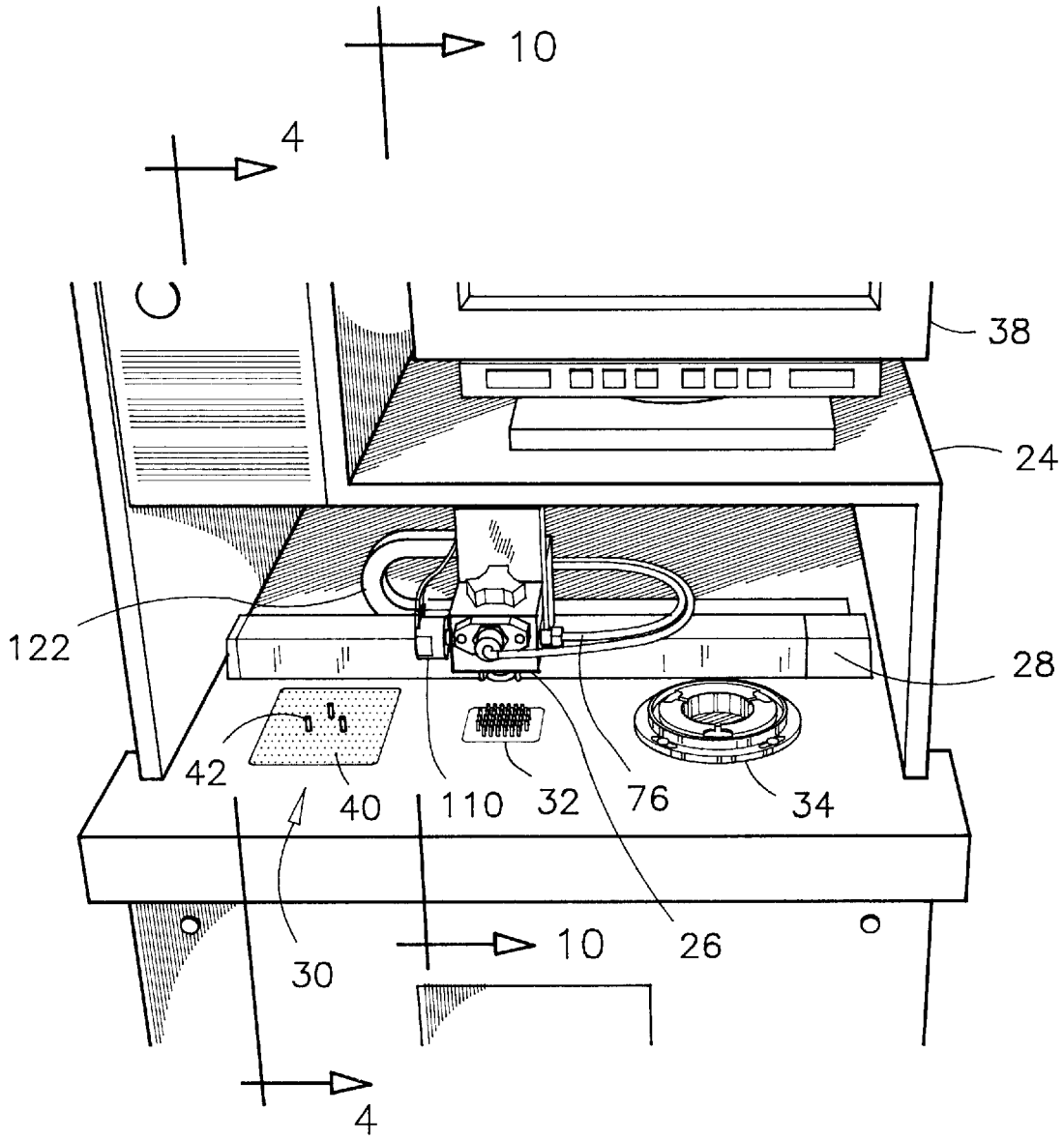
FIG. 3 is an enlarged perspective view of the tabletop surface of the ophthalmic lens blocker of the preferred embodiment.
Figure 4:
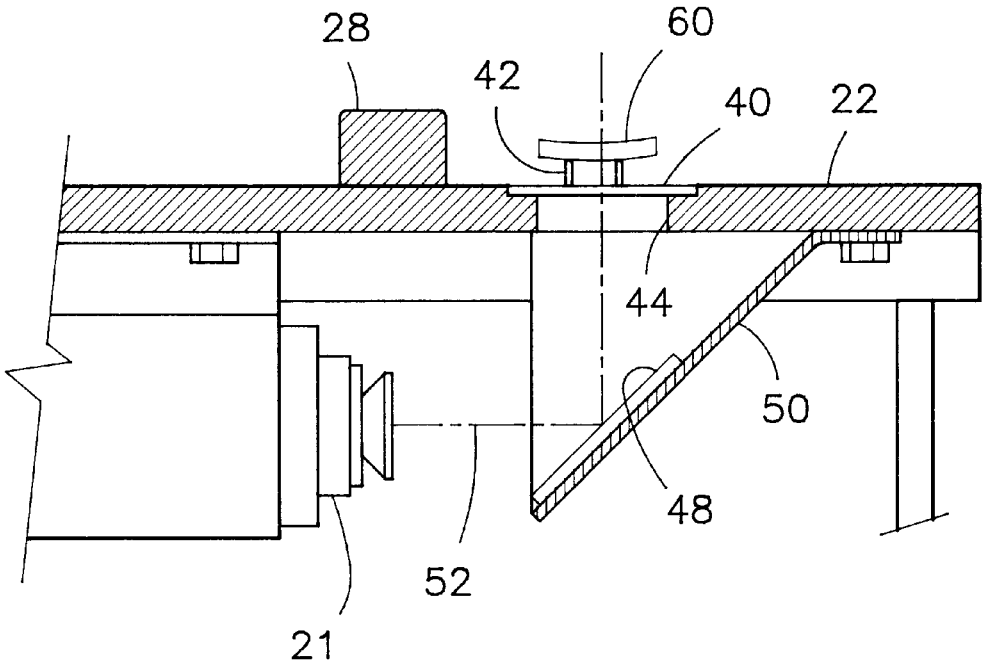
FIG. 4 is a cross-section view of the imaging station taken along line 4—4 in FIG. 3.

Referring now to FIGS. 3 and 4, the imaging station 30 of the lens blocker of the preferred embodiment comprises a ground glass plate 40 having three pegs 42 protruding from the upper surface thereof and defining a triangular formation. The ground glass plate 40 is mounted over an opening 44 in the top surface 22. The camera 21 is mounted under the top surface 22 and is oriented toward a mirror 48 and mirror support structure 50 such that a line of sight 52 of the camera is reflected to make a right angle with the ground glass plate 40.

Figure 5:
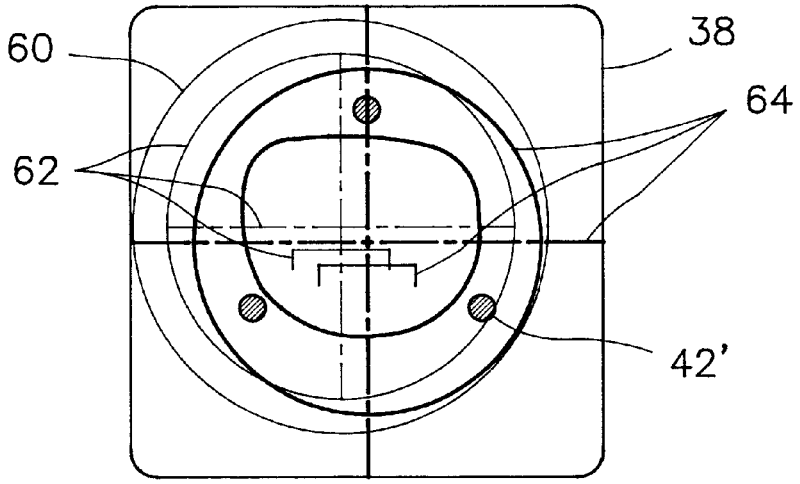
FIG. 5 is a typical projected image of the lens blank and computer generated target, as seen on the CRT screen of the lens blocker of the preferred embodiment.

In use, an ophthalmic lens blank 60 is manually placed on the three pegs 42. The image of the lens blank 60 as seen by the camera 21 through the ground glass plate 40 is instantly displayed on the CRT screen 38 with a superposed computer generated image of the prescribed lens. FIG. 5 illustrates a typical image of an ophthalmic lens being displayed on the CRT screen 38. The manufacturer's markings on the lens blank 60 are represented by label 62. The markings of the computer generated target image of the prescribed lens are indicated by label 64. The markings 62 and 64 typically include a circle around a region of the lens blank having the required optical characteristics, a pair of dashed lines showing the lens geometric center and cylindrical axis, and a rectangular symbol indicating the location of the bifocal segment. The computer generated markings 64 may also contain a contour line showing the frame of the eyeglasses in which the lens is to be mounted. An operator of the lens blocker of the preferred embodiment can thereby easily position the lens blank 60 over the pegs 42 such that the manufacturer's markings 62 on the ophthalmic lens blank 60 coincide with the computer generated markings 64.

When a proper positioning of the lens blank 60 has been effected, the operator requests the computer to register a first position and angular alignment of the lens blank 60 within a horizontal plane, hereinafter referred to as the X-Y plane.

Figure 6:
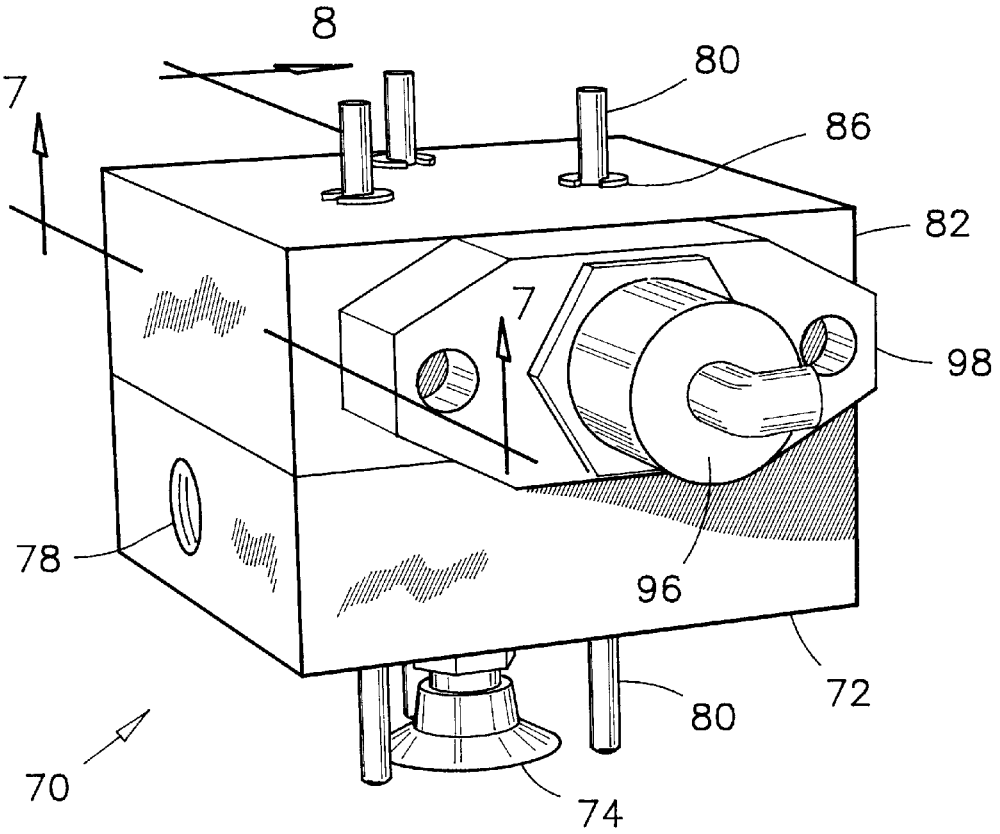
FIG. 6 is a first front, top and left side perspective view of the vacuum pickup device of the ophthalmic lens blocker of the preferred embodiment.
Figure 7:
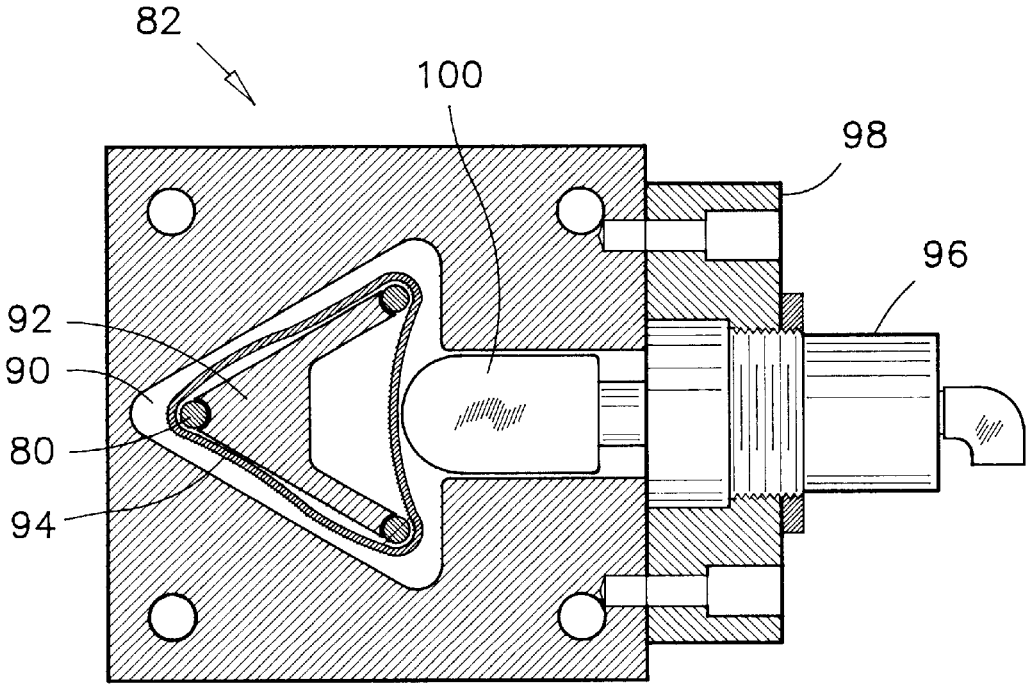
FIG. 7 is a cross-section view of the prop stem locking mechanism taken along line 7—7 in FIG. 6.
Figure 8:
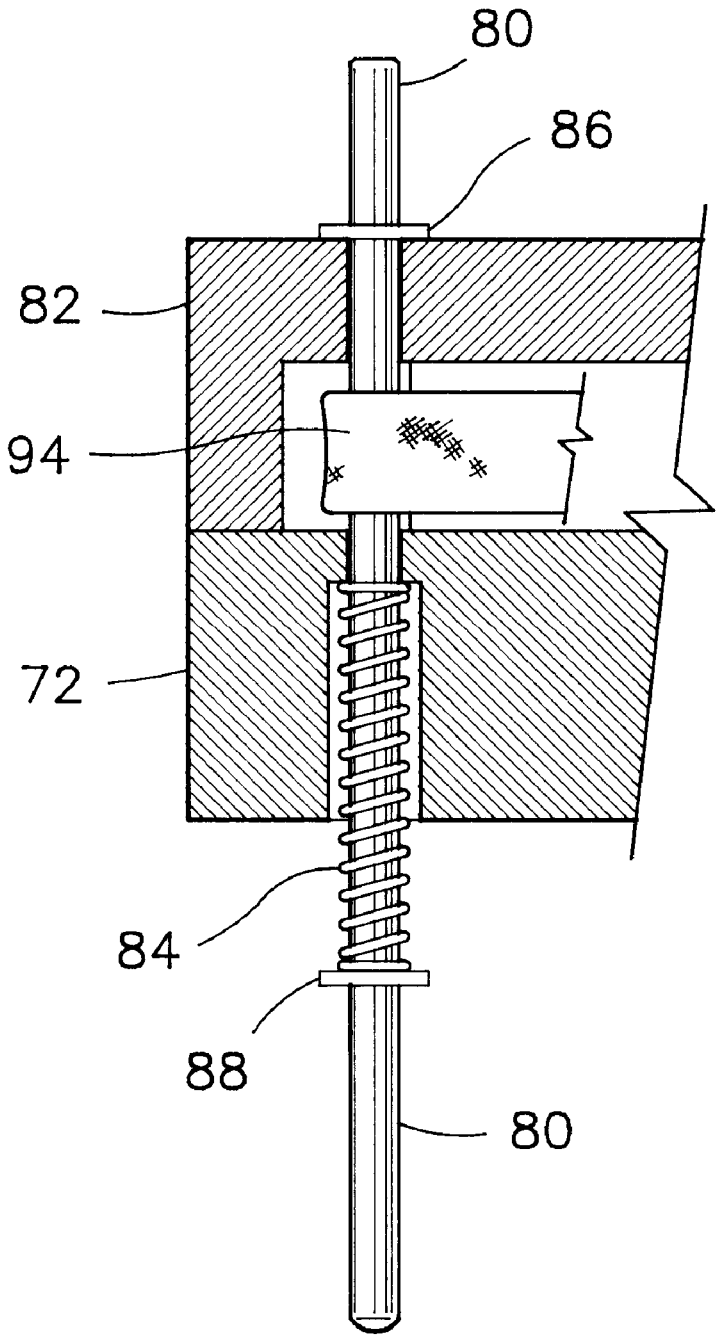
FIG. 8 is a cross-section view through the prop stem locking mechanism and the manifold block taken along line 8 in FIG. 6 and illustrating an elevation view of a prop stem.

Referring now to FIGS. 6–8 there is illustrated therein the vacuum pickup device 70 of the lens blank manipulator 26. The vacuum pickup device 70 comprises a manifold block 72 and a vacuum cup 74 connected to a first opening (not shown) through the underside surface of the manifold block 72. A vacuum source and tubing, indicated by label 76 in FIG. 3 is connected to a second opening in the manifold block and is in communication with the first opening. The manifold block 72 further has a third opening 78 communicating with the first opening.

The vacuum pickup device 70 also comprises three prop stems 80 movably extending in a parallel alignment with the central axis of the vacuum cup 74 and forming a triangular formation around the vacuum cup 74. The vacuum pickup device 70 further has a prop stem locking mechanism 82 mounted atop the manifold block 72.

The prop stems 80 extend through the prop stem locking mechanism 82 and through the manifold block 72 as illustrated in FIG. 8. Each prop stem 80 is urged downward relative to the vacuum pickup device 70 by a spring 84 mounted over the prop stem. Each spring 84 is seated into a respective recess in the manifold block 72. Each prop stem 80 is held in a respective hole through the prop stem locking mechanism 82 and through the manifold block 72 by means of a first lock washer 86 mounted on the upper end of the prop stem 80 and a second lock washer 88 also mounted on the prop stem 80 below the spring 84.

The prop stem locking mechanism 82 comprises a module made of rigid material and having a triangular cavity 90 formed therein. The triangular cavity 90 encloses an A-shaped protrusion 92 extending from a bottom surface of the cavity 90 and having a thickness similar to the depth of the cavity. The A-shaped protrusion 92 and the triangular cavity 90 are concentric with one-another and are positioned such that each of the three extremities of the A-shaped protrusion 92 is contiguous with a surface along one of the prop stems 80. The prop stem locking mechanism 82 further has in the triangular cavity 90, a flat belt 94 enclosing the A-shaped protrusion and the three prop stems 80.

A pneumatic cylinder 96 is affixed to the side of the prop stem locking mechanism 82 by a collar 98 and fasteners (not shown) through the collar 98 and threaded into the rigid module of the mechanism 82. The pneumatic cylinder 96 has an operable plunger 100 extending into the base of the A-shaped protrusion 92. An extending of the plunger 100 pushes upon the flat belt 94 and stretches the flat belt 94 around the three prop stems 80. The tension in the flat belt 94 causes each prop stem 80 to be pulled and held tightly against a respective extremity of the A-shaped protrusion 92.

Figure 10:
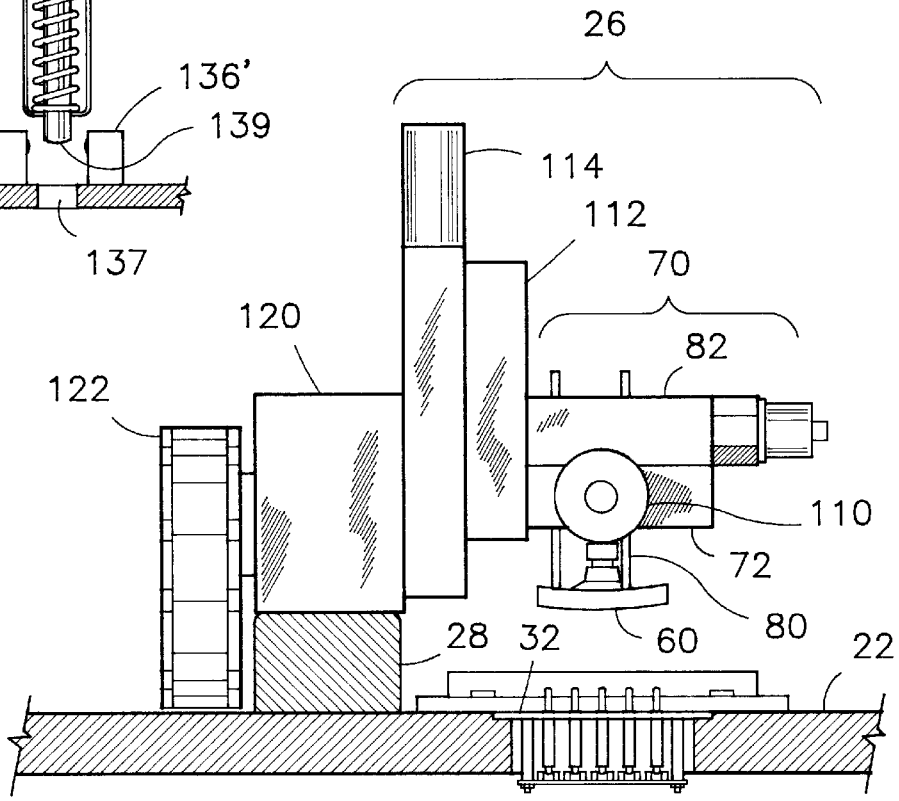
FIG. 10 is cross-section view of the probing station of the ophthalmic lens blocker of the preferred embodiment taken along line 10—10 in FIG. 3.
Figure 13:
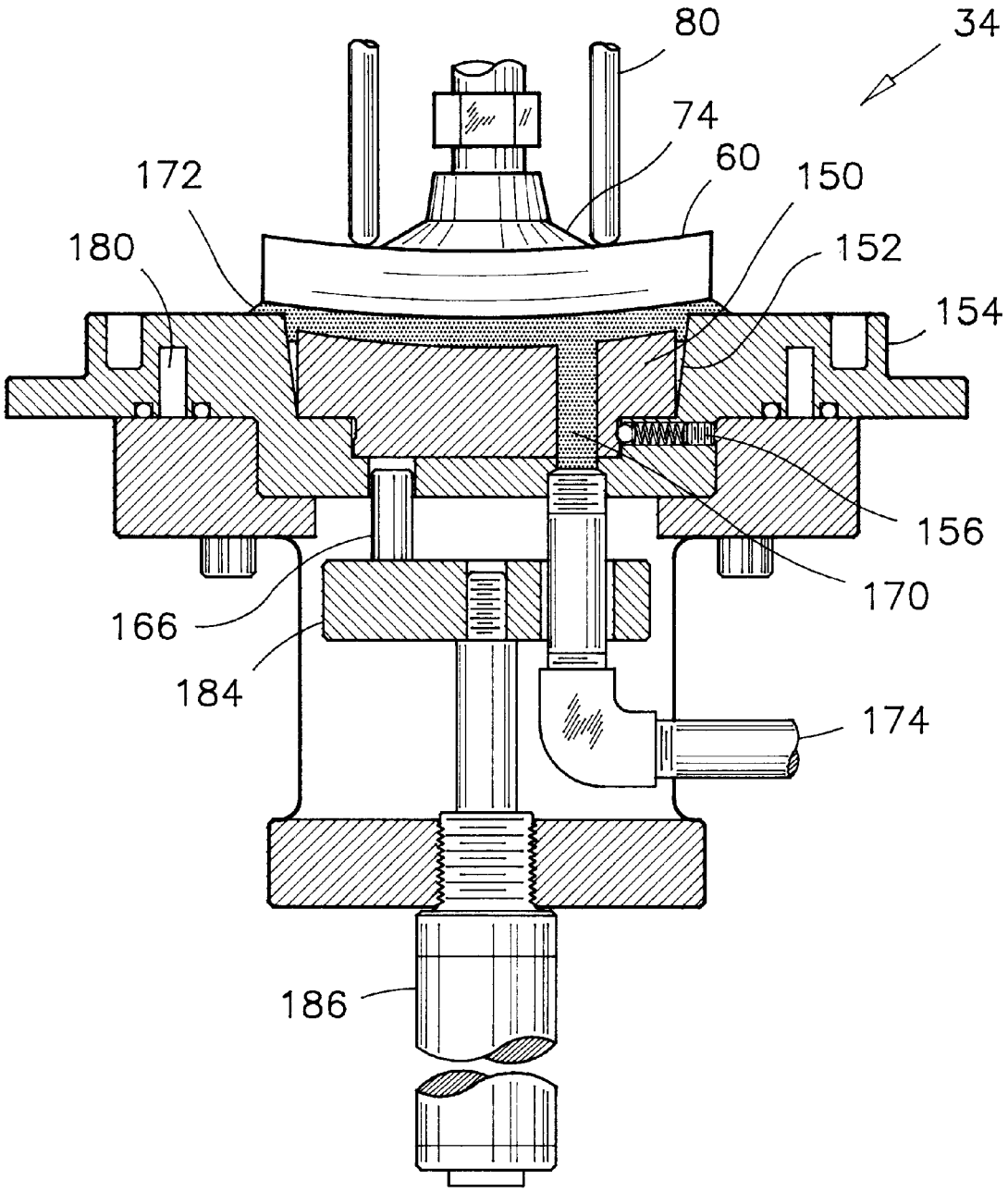
FIG. 13 is a vertical cross-section view of the lens/block moulding station of the ophthalmic lens blocker of the preferred embodiment.
Figure 14:
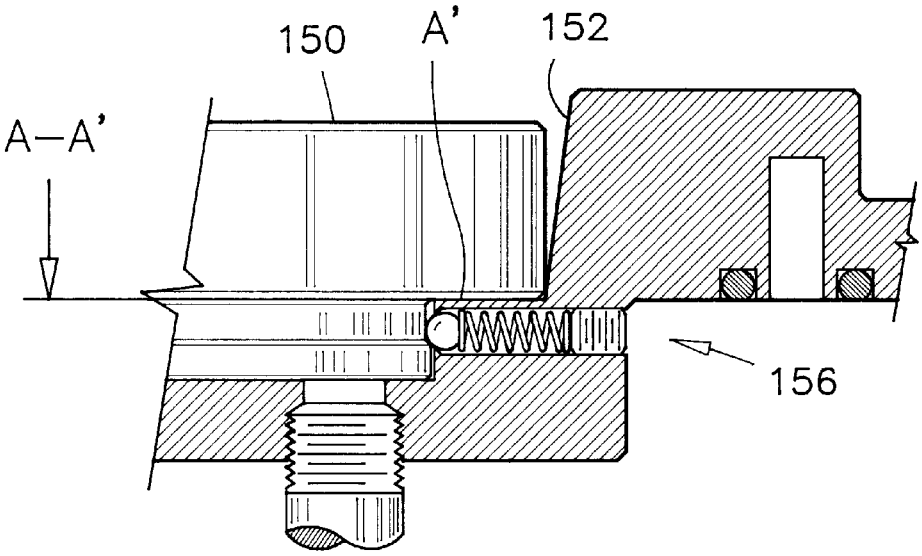
FIG. 14 is an enlarged detail of the cavity inside the lens/block moulding station for receiving and holding a support block.
Figure 15:
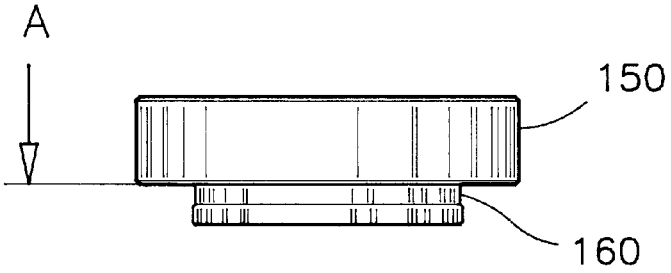
FIG. 15 is a side view of a typical support block used for blocking an ophthalmic lens blank.
Figure 16:
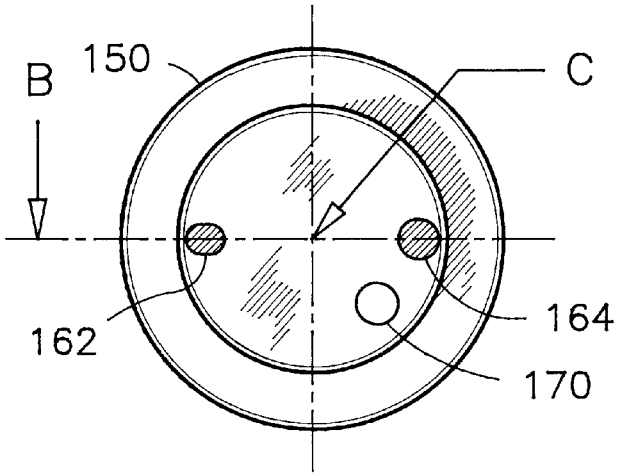
FIG. 16 is a bottom view of a typical support block used for blocking an ophthalmic lens blank.

The action of the pneumatic cylinder 96 is controlled by the CPU in response to a vacuum sensor switch 110 which is illustrated in FIGS. 3 and 10. The vacuum sensor switch 110 is connected to the third opening 78 and monitors the vacuum level in the vacuum cup supply port. In operation, the vacuum cup 74 is lowered on a lens blank 60 and the vacuum cup 74 and the prop stems 80 are brought in contact with the lens blank 60. The vacuum level in the vacuum cup supply port increases and causes the vacuum sensor switch 110 to send a signal to the CPU which in turn activates the pneumatic cylinder 96 for locking the position of the prop stems 80. The lens blank is thereby rigidly retained in the vacuum cup 74.

The raising and lowering movements of the vacuum pickup device 70 are effected by a second linear actuator 112, also shown in FIG. 10. The movements of the second linear actuator 112 are controlled by a second servo motor or a stepper motor/encoder unit 114 such that after an initial calibration, a position of the vacuum cup 74 is always known precisely. When the vacuum pickup device 70 picks up a lens blank 60 from the imaging station 30, the CPU reads the vacuum sensor switch 110 and the signal of the second motor/encoder unit 114 and registers a first vertical position of the concave surface of the lens blank 60 relative to a vertical axis, hereinafter referred to as the Z-axis.

Although vacuum cups in general are known to be somewhat flexible, the locked-in-place prop stems 80 ensure that the first vertical position registered by the CPU is maintained throughout the remaining functions of the lens blocker of the preferred embodiment.

It will be appreciated by the person skilled in the art that an alternate embodiment for the vacuum cup 74 and the vacuum sensor switch 110 described above may be used for obtaining the results contemplated by the vacuum pickup device 70 of the preferred embodiment. Another known type of vacuum cup for example has a rod-like probe mounted centrally therein and a proximity or optical switch for monitoring the position of the probe. This type of vacuum cup may be calibrated to obtain the aforesaid results, and may be preferred by some machine designers and builders to accommodate different configurations of vacuum pickup devices 70 for example.

Figure 9:
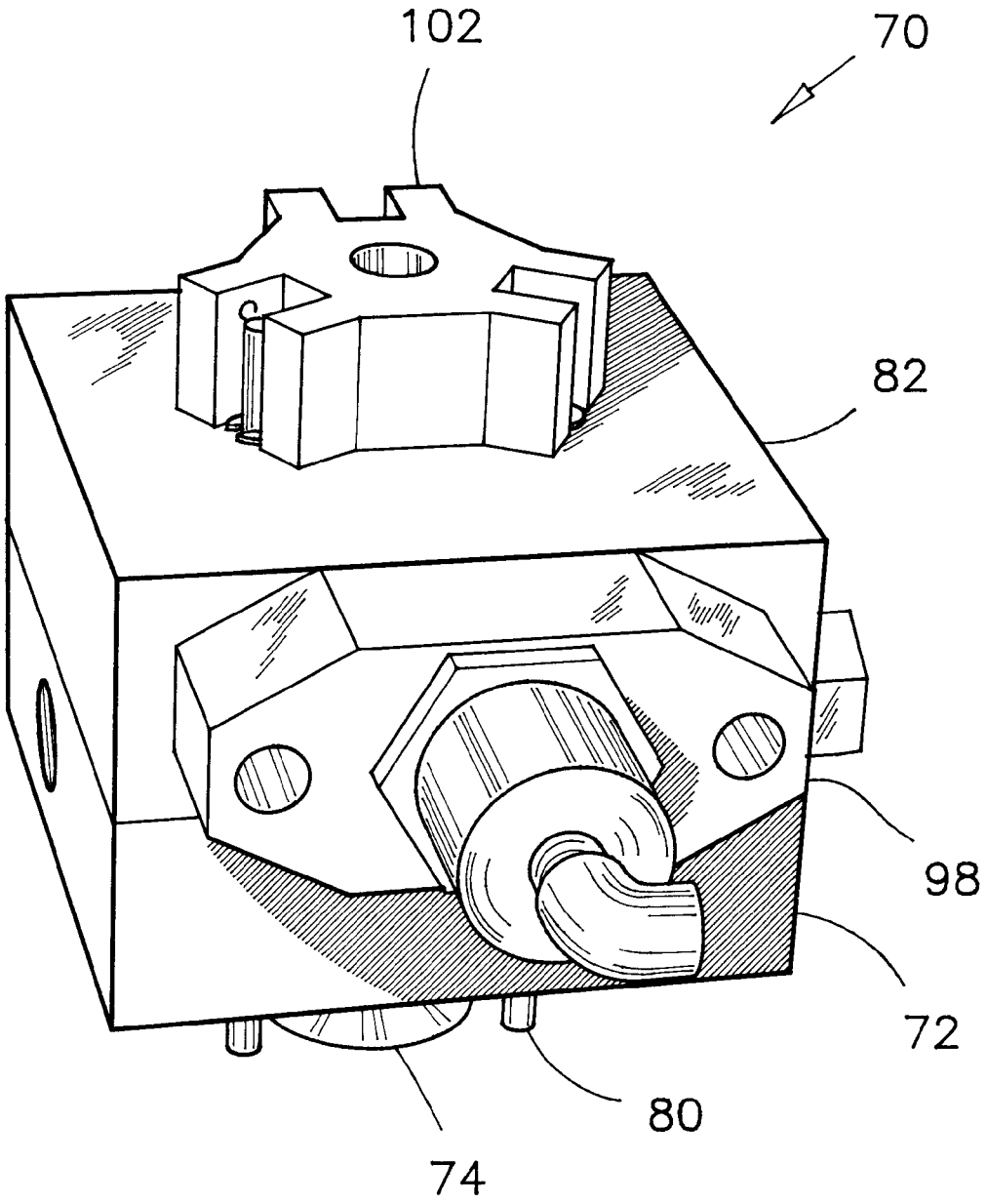
FIG. 9 is a second front, top and left side perspective view of the vacuum pickup device of the ophthalmic lens blocker of the preferred embodiment having photoelectric switches mounted atop thereof.

The vacuum pickup device 70 preferably has an electronic module 102 containing photoelectric switches for monitoring a movement of the prop stems 80. The electronic module 102 is preferably mounted atop the prop stem locking mechanism 82, as illustrated in FIG. 9. The signals from the electronic module 102, the signal from the vacuum sensor switch 110 and the signals from the second motor/encoder unit 114 when the vacuum pickup device is brought in contact with the concave surface of the lens blank are integrable for determining or verifying the curvature of the concave surface of the lens blank 60.

Referring now particularly to FIG. 10, the lens blank manipulator 26 is mounted on a carrier block 120 affixed to the movable member (not shown) of the first linear actuator 28. The control wiring between the CPU and the lens blank manipulator 26 are preferably routed over a flexible cable tray 122 which is affixed to the top surface 22 of the cabinet 20 and to the carrier block 120.

Figure 11:
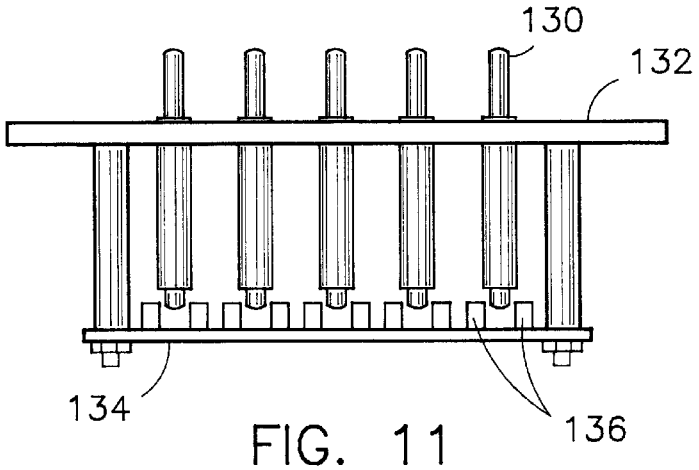
FIG. 11 is an elevation view of the array of gauge plungers of the probing station of the ophthalmic lens blocker of the preferred embodiment.
Figure 12:
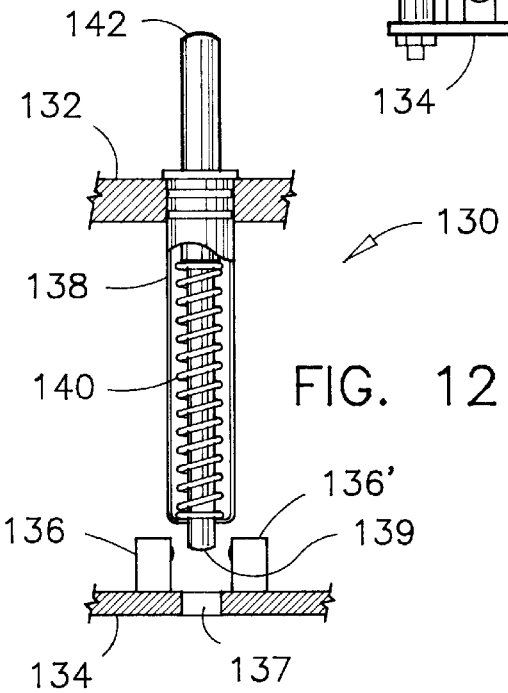
FIG. 12 is an enlarged, partial cross-section view of a gauge plunger of the probing station.

Once the lens blank 60 is held by the vacuum pickup device 70, the lens blank is transported from the imaging station 30 to the probing station 32. The structural details of the probing station 32 are illustrated in FIGS. 11 and 12.

The probing station 32 comprises a rectangular array of gauge plungers 130 protruding upwardly through a cover plate 132. The gauge plungers 130 extend under the cover plate 132 and near a circuit board 134 affixed at a distance from the cover plate. The circuit board 134 has a plurality of photoelectric switches wherein each switch comprises a photoelectric emitter 136 and a photoelectric receiver 136'. Each photoelectric switch 136–136' is positioned at closed proximity from a lower end of one plunger 130 for monitoring a downward displacement of that plunger 130.

Each gauge plunger 130 comprises a tubular housing 138 which is affixed to the cover plate 132. A rod 139 is movably mounted in the housing 138 and is urged upwardly by a spring 140. Each rod 139 has a rounded tip 142 extending above the cover plate 132. The circuit board 134 further has a hole 137 between each emitter 136 and receiver 136' for allowing a downward movement of each rod 139 through the circuit board 134 when the rounded tip 142 is depressed.

When the lens blank 60 is lowered on the probing station with the convex surface of the lens blank 60 contacting the tips 142 of the gauge plungers 130, the CPU reads the encoder of the second stepper motor/encoder unit 114 and the signal from each photoelectric switch 136–136'. The CPU integrates the signals of the encoder and switches 136–136' to determine the curvature of the lens blank 60 and a position of this curvature along the Z-axis.

Referring now particularly to FIGS. 13–16, the bonding of a lens blank to a support block comprises the step of manually inserting a support block 150 in the cavity 152 of the seat ring 154 of the lens/block moulding station 34. The support block 150 is held inside the cavity 152 by a series of spring-ball lock devices 156. The spring-ball devices 156 act upon a groove 160 in the support block for providing a snap-locking action when mounting the block 150 inside the cavity 152 and for retaining the support block 150 inside the cavity 152 such that a first shoulder A on the block 150 is held against a second shoulder A' inside the cavity 152. As will also be appreciated, other chuck means may be used at the discretion of the machine designer or builder to positively retain the support block 150 against the second shoulder A'.

The support block 150 has a pair of locating holes through the lower surface thereof for indexing the block inside the cavity 152. The locating holes comprise an oblong hole 162 and a round hole 164 placed at 180° apart. The location of both holes coincides with a pair of pins inside the cavity 152. One of the locating pins is referenced by label 166 in FIG. 13. The mounting of a support block 150 inside the cavity 152 of the lens/block moulding station 34 is thereby a precise mounting wherein the plane A, the transversal axis B across both position holes 162,164 and the center C of the block are consistent for all support blocks 150 inserted in the lens/block moulding station 34.

The support block 150 further has a third hole 170 through the entire thickness thereof for injecting molten wax 172 between the lens blank 60 and the mounting surface of the block 150. The third hole 170 is connectable to molten wax injection piping system 174 which in turn is connected to the wax heating and pumping unit 25.

A further movement of the lens blank manipulator 26 comprises the transfer of the lens blank 60 from the probing station to the lens/block moulding station 34 wherein the lens blank is bonded to a support block 150. Because the position of the convex surface of the lens blank 60 along the Z-axis is known by the CPU, the lens blank is precisely positioned over the block, with the concave surface thereof being at a nominal distance from the mounting surface of the block 150 in order to achieve all the aforesaid advantages of such mounting. Molten wax 172 is then injected between the support block 150 and the lens blank 60 and is allowed to cool and solidify for bonding the lens blank 60 to the mounting block 150.

The seat ring 154 preferably has a circular conduit 180 therein for recirculating a coolant from the chiller 27 for cooling the seat ring 154 and the mounting block 150, and for promoting a rapid hardening of the molten wax 172. The lens/block moulding station 34 also preferably has a movable platen 184 holding the locating pins 166. The platen is movable in up and down directions for pushing the locating pins 166 upwardly and for dislodging the block 150 from inside the cavity 152 when the wax has solidified and the lens blank 60 is bonded to the support block 150. The platen 184 is actuated in up and down directions by a pneumatic actuator 186.

During the imaging and probing of a lens blank 60, the CPU of the ophthalmic lens blocker of the preferred embodiment registers the X-Y coordinates of the geometric center of the lens blank, the position and orientation of the cylindrical axes of the lens blank, the location of the bifocal segment. It also registers the shape and location of the convex surface of the lens blank along the Z-axis, the shape and position of the concave surface along the Z-axis and the thickness of the lens blank. During the blocking of the lens blank 60 these data are related to the coordinates of the plane A, transversal axis B and center C of the support block 150. The lens blank and block assembly are also assigned an identification code by the CPU under which the above mounting specifications are registered in the memory of the CPU. The data, spacial coordinates and identification code are later used in other apparatus communicating with the CPU for working the lens blank according to the specifications of a prescription.

While the above description provides a full and complete disclosure of the preferred embodiment of this invention, various modifications, alternate constructions and equivalents may be employed without departing from the true spirit and scope of the invention. Such changes might involve alternate materials, components, structural arrangements, sizes, construction features or the like. Therefore, the above description and the illustrations should not be construed as limiting the scope of the invention which is defined by the appended claims.

I claim:

1. An ophthalmic lens blocker for blocking a lens blank onto a support block, comprising:

a first station for operating on a lens blank;

a second station for operating on a lens blank, disposed near said first station; and a lens blank manipulator having means for moving said lens blank from said first station to said second station, said first station being a lens blank imaging station having means for displaying a planar coordinate system and means for supporting said lens blank for orienting said lens blank according to references in said planar coordinate system;

said second station being a lens/block moulding station disposed aside said lens blank imaging station and having means for receiving said support block in a known position and means for bonding said lens blank to said support block; and said means for moving said lens blank comprising a lens blank pickup device having holding means for holding said lens blank and a plurality of prop means disposed about said holding means for contacting and stabilizing said lens blank when said lens blank is held in said holding means;

such that a position of said lens blank in said holding means is precisely maintainable when said lens blank is moved from said first station to said second station.

2. An ophthalmic lens blocker as claimed in claim 1 wherein said pickup device further has a pulling axis generally perpendicular to a surface of said lens blank when said lens blank is held in said holding means.

3. An ophthalmic lens blocker as claimed in claim 2 wherein said plurality of prop means is three stiff prop stems arranged in a triangular formation around said holding means and each of said stiff prop means has a longitudinal axis aligned in a parallel relationship with said pulling axis.

4. An ophthalmic lens blocker as claimed in claim 3 wherein each of said prop stems is movable along said longitudinal axis, and has a spring mounted thereon for urging a lower end thereof against said lens blank when said holding means is brought in contact with said lens blank.

5. An ophthalmic lens blocker as claimed in claim 3 wherein said holding means is a vacuum cup and said lens blank pickup device has first sensor means for detecting a position of said vacuum cup relative to said lens blank when said vacuum cup is brought in contact with said lens blank.

6. An ophthalmic lens blocker as claimed in claim 5 wherein said lens blank pickup device has a prop stem locking mechanism for selectively locking a position of said prop stems along said longitudinal axes.

7. An ophthalmic lens blocker as claimed in claim 2 wherein said means for moving said lens blank comprises a first linear actuator having first position encoder means for moving said lens blank between said imaging station and said lens/block moulding station and a second linear actuator means, disposed generally perpendicularly relative to said first linear actuator means and having second position encoder means, for taking said lens blank from said imaging station and for placing said lens blank on said lens/block moulding station.

8. An ophthalmic lens blocker as claimed in claim 7 further having a central processor unit for controlling an operation thereof; and wherein said prop stem locking mechanism further comprises second sensor means for detecting an extent of said prop stems, whereby an extent signal from said second sensor means, a position signal from said first sensor means and relative positions of said second linear actuator means when said extent signal is given and when said position signal is given, when said lens blank pickup device is brought in contact with said lens blank, are integrable by said central processor unit for calculating a curvature of a first surface of said lens blank towards said lens blank pickup device and for determining a spacial location of said first surface relative said second linear actuator means.

9. An ophthalmic lens blocker as claimed in claim 8 further having a lens blank probing station having means for measuring a spacial location and curvature of a second surface of said lens blank opposite said first surface, whereby a thickness of said lens blank is calculable by said central processor unit, and said lens blank is bondable to said support block at a nominal distance from said support block.

10. An ophthalmic lens blocker for blocking a lens blank onto a support block comprising:

a lens blank probing station having means for measuring a spacial location and curvature of a surface of said lens blank;

a lens/block moulding station disposed near said lens blank probing station, and having means for receiving said support block in a known position and means for bonding said lens blank to said support block, and a lens blank manipulator having means for moving said lens blank from said lens blank probing station to said lens/block moulding station; said lens blank manipulator having means for effecting a controlled motion thereof, and a central processor unit for controlling an operation thereof and for registering said spacial location and curvature of said surface of said lens blank when said lens blank is measured at said probing station, and for monitoring a displacement of said surface when said lens blank is moved to said lens/block moulding station;

whereby said lens blank is bondable to said support block at a nominal distance from said support block with said location of said surface being associable with said known position of said support block.

11. An ophthalmic lens blocker as claimed in claim 10 further comprising a tabletop surface wherein said probing station and said lens/block moulding station are juxtaposed in said tabletop surface.

12. An ophthalmic lens blocker as claimed in claim 11 wherein said means for measuring a spacial location and curvature of a surface of said lens blank comprises a cover plate disposed in said tabletop surface, a circuit board affixed at a distance below said cover plate and a rectangular array of gauge plungers each having an upper end and a lower end with said upper end extending through said cover plate and above said cover plate; said circuit board having a plurality of switch means each being disposed near a lower end of one of said gauge plungers for monitoring a displacement of said one of said gauge plungers; whereby relative positions of said position encoder means and individual signal from said switch means, when said lens blank is moved towards said probing station with said surface of said lens blank contacting said upper ends of said gauge plungers, are integrable by said central processor unit for determining said spacial location and curvature of said surface of said lens blank.

13. An ophthalmic lens blocker as claimed in claim 12 wherein said plurality of switch means are photoelectric switches respectively monitoring displacements of said lower ends of said gauge plungers.

14. An ophthalmic lens blocker as claimed in claim 10 wherein said means for moving said lens blank comprises a lens blank pickup device having: holding means for holding said lens blank; a pulling axis generally perpendicular to a surface of said lens blank when said lens blank is held in said holding means, and a plurality of stiff prop means disposed about said holding means, each of said prop means having a longitudinal axis aligned in a parallel relationship with said pulling axis, for contacting and stabilizing said lens blank when said lens blank is held in said holding means.

15. An ophthalmic lens blocker for blocking a lens blank onto a support block comprising:

a lens blank imaging station having means for displaying a planar coordinate system and means for supporting said lens blank for orienting said lens blank according to references in said planar coordinate system;

a lens/block moulding station disposed aside said lens blank imaging station, having means for receiving said support block in a known position and having means for bonding said lens blank to said support block, a lens blank manipulator having means for moving said lens blank from said lens blank imaging station to said lens/block moulding station; said lens blank manipulator also having linear actuator means with position encoder means for effecting a controlled motion thereof; said means for moving said lens blank comprising a lens blank pickup device having a manifold block and a vacuum cup mounted in said manifold block;

a source of vacuum connected to said vacuum cup for operating said vacuum cup, and a central processor unit for controlling an operation thereof;

said means for moving said lens blank further having vacuum cup position sensor means connected to said vacuum cup for sensing a position of said vacuum cup relative to said lens blank when said vacuum cup is brought in contact with a first surface of said lens blank, and a plurality of movable prop stems spaced around said vacuum cup and extending beyond a projection of said vacuum cup from said manifold block, said prop stems each having a longitudinal axis extending in a parallel alignment with a pulling axis of said vacuum cup; said prop stems having spring means affixed thereto for urging said prop stems in a direction of said projection of said vacuum cup; and said lens blank pickup device further having switch means for detecting an extent of said prop stems when said prop stems are brought in contact with said first surface of said lens blank;

whereby a signal from said switch means upon a touching of said prop stems to said first surface of said lens blank and a signal from said vacuum cup position sensor means when said vacuum cup is brought in contact with said first surface of said lens blank and corresponding positions registered by said position encoder means are integrable by said central processor unit for determining a spacial location and curvature of said first surface of said lens blank relative said position encoder means.

16. An ophthalmic lens blocker as claimed in claim 15 wherein said switch means are a plurality of photoelectric switches each monitoring the extent of one of said prop stems.

17. An ophthalmic lens blocker as claimed in claim 15 further having a prop stem locking mechanism affixed to said manifold block, control means associable with said vacuum cup position sensor means and means for locking said prop stems in a fixed position relative to said vacuum cup, whereby when said vacuum cup is brought in contact with said first surface of said lens blank and said vacuum cup position sensor means is activated, said prop stem locking mechanism is operable for rigidly restraining a movement of said prop stems and for stabilizing said lens blank relative to said vacuum cup.

18. An ophthalmic lens blocker as claimed in claim 17, further having a lens blank probing station generally disposed aside said lens blank imaging station and said lens/block moulding station, and having means for measuring a curvature and location of a second surface of said lens blank relative to said position encoder means, whereby said lens blank is bondable to said support block at a nominal distance and spacial orientation relative said known position.

19. An ophthalmic lens blocker as claimed in claim 18 further comprising a tabletop surface wherein said imaging station, said probing station and said lens/block moulding station are juxtaposed in said tabletop surface.

20. An ophthalmic lens blocker as claimed in claim 19 wherein said central processor unit comprises a CRT screen disposed above said tabletop surface, said CRT screen being a touch-type screen whereby an operation of said central processor unit is controllable by touching command buttons appearing on said CRT screen.

* * * * *